US006213923B1

(12) United States Patent
Cameron et al.

(10) Patent No.: US 6,213,923 B1
(45) Date of Patent: Apr. 10, 2001

(54) BACK EXERCISE DEVICE

(75) Inventors: William J. Cameron; Brenda S. Dykgraaf, both of Windermere, FL (US); Francois Duchesne, Mont-Royal (CA)

(73) Assignee: Cape Hatteras Management Limited, Georgetown, Grand Cayman ( * ) Notice: Subject to any disclaimer, the term of this patent is extended or adjusted under 35 U.S.C. 154(b) by 0 days.

(21) Appl. No.: 09/281,508

(22) Filed: Mar. 30, 1999

(51) Int. Cl.[7] ..... A63B 26/00

(52) U.S. Cl. ..... 482/142; 482/140; 128/71; 297/50

(58) Field of Search ..... 482/140, 142; 280/647; D12/131; 606/242, 327; 297/50, 318; 128/71–74

(56) References Cited

U.S. PATENT DOCUMENTS

| | | | | |
|---|---|---|---|---|
| D. 394,481 | | 5/1998 | DeLisse | D21/191 |
| 2,579,783 | * | 12/1951 | Branto | 606/242 |
| 2,722,967 | * | 11/1955 | Reinholz | 155/69 |
| 3,716,230 | * | 2/1973 | Mark | 272/58 |
| 3,767,190 | * | 10/1973 | Biggerstaff | 272/58 |
| 4,144,880 | * | 3/1979 | Daniels | 606/242 |
| 4,372,553 | | 2/1983 | Hatfield | 272/119 |
| 5,169,372 | | 12/1992 | Tecco | 482/140 |
| 5,267,931 | | 12/1993 | Faetini | 482/140 |
| 5,492,520 | | 2/1996 | Brown | 482/140 |
| 5,577,987 | | 11/1996 | Brown | 482/140 |
| 5,692,996 | | 12/1997 | Widerman | 482/93 |
| 5,709,634 | | 1/1998 | Pointer | 482/105 |
| 5,725,463 | | 3/1998 | Colonello et al. | 482/140 |
| 5,728,035 | | 3/1998 | Sands | 482/140 |
| 5,779,607 | | 7/1998 | Harris | 482/140 |

* cited by examiner

*Primary Examiner*—Jerome W. Donnelly
*Assistant Examiner*—Lori Baker Amerson
(74) *Attorney, Agent, or Firm*—Fulbright & Jaworski, LLP

(57) ABSTRACT

An exercise device and methods for strengthening the muscles of lower back and abdomen. The device may be configured to impart extension to the spine of a user. The device may include a reclinable chair having a backrest pivotally attached to a seat. The backrest may be pivotally declined backwards in relation to the seat by a user during exercise. The device may include a decline control mechanism that is selectively operable to resist the decline of the backrest, to limit the maximum angle of decline of the backrest relative to the seat, or both.

24 Claims, 13 Drawing Sheets

BACK EXERCISE DEVICE

BACKGROUND OF THE INVENTION

1. Field of the Invention

This invention relates generally to exercise devices, and more particularly, to exercise devices for strengthening muscles of the lower back and abdominal muscles. Specifically, this invention relates to a device for imparting extension to the spine of a user.

2. Description of the Related Art

Lower back pain is a common complaint. Often lower back pain is associated with sedentary lifestyles. Posture responsible for lower back pain may be related to occupations or lifestyles which include a large amount of sitting and/or leaning forward. Poor lifting and bending posture may also result in lower back pain. Recently, it has been recognized that a majority of back pain is mechanical in origin, and that physical activity is the cornerstone of low-back rehabilitation.

One recognized treatment for chronic lower back pain is physical exercise including extension of the spine. As used herein, "extension of the spine" refers to movement which bends the spine backwards through contraction of the lumbar extensor muscles. In the past, exercises for extending and strengthening the lower back have included floor exercises and exercises using inversion therapy devices. A floor exercise program for developing back strength may be difficult to implement and maintain for some patients who have weak backs or are poorly conditioned. Furthermore, the amount of spinal extension provided by such floor exercises is typically limited.

Inversion therapy devices are typically relatively expensive and bulky, and relatively difficult to operate by one person. Common inversion therapy devices include those having a tiltable table for supporting a user in a number of different positions. Such devices typically include foot clamps attached at one end of the table for suspending the patient when the table is placed in an inverted position. A user typically mounts such a device with the table in near-upright position and straps their feet to foot clamps at the base of the table. The user may then be positioned in various positions of partial and full inversion by tilting and rotating the table backwards. Besides being bulky and relatively expensive, such inversion devices may cause or aggravate health problems for hypertensive individuals. In addition, while inversion devices may provide some unloading of the spinal column of the lower back by virtue of gravity inversion, no spinal extension is typically imparted to the user due to the flat surface of the table.

SUMMARY OF THE INVENTION

Disclosed is a device and method for greatly improving the strength and flexibility of the lower back, abdominals and obliques of, for example, both individuals who are suffering from lower-back pain, and individuals who do not suffer from lower-back pain but who wish to gain strength and flexibility in the their lumbar extensor muscles. The disclosed method and device may be used to provide a user with the ability to strengthen and stabilize lumbar extensor muscles through extension movements as well as the abdominals and obliques through flexion movements. The lower back and hamstrings may also be kept flexible to minimize back strain or sprain. Due to its relatively simple design and wide range of decline angle and resistance control(s), the disclosed device facilitates regular workouts for users having lower back pain. Such regular exercise may help alleviate lower back pain relatively quickly, and may strengthen muscles that support the back to improve flexibility, and reduce the chance of future acute attack.

Advantageously, the disclosed device is relatively compact and simple to use to provide extension to a user's back in addition to unloading of the spinal column. Using the disclosed device, a user may strengthen lower back and abdominal muscles, plus increase and maintain flexibility in the trunk, so as to reduce the incidence of future low-back pain. Further advantageously, the disclosed device may also serve as a static workout bench for whole body strength-training program. Thus, one disclosed embodiment is a relatively inexpensive and compact exercise device which provides the combined functions of a back extension machine, abdominal conditioning machine and weight bench.

Surprisingly, use of the disclosed device and method allows users suffering lower-back pain to reduce future incidence of such pain by strengthening and increasing flexibility in the lower back while comfortably positioned off the floor, rather than lying and performing traditional back exercises on a floor. By providing extension to the spinal column, the disclosed method and device address low-back pain in a manner superior to traditional or conventional inversion devices which utilize a flat table. In one embodiment, a foam-padded backrest and seat help support a user's body throughout the range of motion, and optional lumbar support may be provided.

As a further advantage, one embodiment of the disclosed method and device allows a user to customize the degree of extension according to physical ability and/or doctor's or chiropractor's advice.

Advantageously, in various other embodiments, an adjustable footbar, hand hold positions, and relatively simple decline and resistance controls allow the disclosed device to be operated by users from poorly conditioned beginners to well-conditioned athletes. Furthermore, a wide assortment of settings, wide backrest and features noted above also make the disclosed device ideal for use by an entire family.

In one exemplary embodiment, the disclosed device is an adjustable chair which may be declined at varying angles by a user. Advantageously, the angle of decline as well as the amount of resistance inherent in the movement of the chair may be easily controlled by the user. Furthermore, the angle of decline may exceed 180° as measured between the plane of the backrest and the plane of the seat of the chair so as to result in extension of the spine, thus providing superior motion for back rehabilitation as compared to conventional methods and devices employing flat-surfaces.

In one respect, disclosed is an exercise device including a back rest having a first surface and first and second ends; a seat having a first surface and first and second ends, the first end of the seat being disposed adjacent the second end of the back rest, wherein a plane of the back rest and a plane of the seat define an angle of decline between the first surface of the back rest and the first surface of the seat; and a support frame supporting the back rest and the seat, wherein the back rest and the seat are pivotally movable relative to each other so that the angle of decline may be adjustable. The back rest and the seat together may be adapted to receive a user in an exercise position wherein the first surface of the back rest supports an upper back of the user, and wherein the first surface of the seat supports a posterior of the user. The angle of decline may be adjustable from an angle of less than about 180° to an angle of greater than about 180°. The angle of decline may also be adjustable between a minimum angle and a maximum angle, the minimum angle being from about 65° to about 215°, and the maximum angle being from about 180° to about 235.

The exercise device may further include a decline control mechanism, the decline control mechanism being operable to limit adjustment of the angle of decline. In this regard, the decline control mechanism may be operable to limit adjustment of the angle of decline to a maximum decline angle of from about 180° to about 235°. Additionally or alternatively, the decline control mechanism may be operable to resist adjustment of the angle of decline, and in one embodiment, the decline control mechanism may be operable to selectively prevent or resist adjustment of the angle of decline. In another embodiment, the decline control mechanism may be selectively operable to limit adjustment of the angle of decline to at least two different operable decline angle ranges.

In another respect, this invention is an exercise device, including a back rest having first and second ends; a seat having first and second ends, the first end of the seat being pivotably attached to the second end of the back rest at a device pivot point, wherein a plane of the back rest and a plane of the seat form an angle of decline therebetween; and a support frame pivotally supporting the back rest at a first point positioned between the first and second ends of the back rest, and pivotally supporting the seat at a second point positioned between the first and second ends of the seat. The back rest and the seat together may form an extension platform capable of receiving a user in an exercise position wherein the first surface of the back rest supports an upper back of the user, and wherein the first surface of the seat supports a posterior of the user; and the angle of decline may be adjustable up to a maximum value of from about 180° to about 235°. In one embodiment, the maximum angle of decline may be sufficient to cause extension of the back of the user when the user may be received by the first surfaces of the back rest and the seat. The angle of decline may be adjustable between a minimum angle and the maximum angle, the minimum decline angle being from about 65° to about 180°.

The exercise device may further include a decline control mechanism operable to limit a range of adjustment of the angle of decline, operable to resist adjustment of the angle of decline, or both. In one exemplary embodiment, the decline control mechanism may have a trailing arm having first and second ends and a decline control slot defined therein between the first and second ends of the trailing arm, the decline control slot being closed at each end; the first end of the trailing arm being pivotally attached to the extension platform at a point adjacent the device pivot point; and a decline control pin connected to the support frame, the decline control pin being received in the decline control slot so that adjustment of the angle of decline causes the decline control slot to slidably travel about the decline control pin, the adjustment of the angle of decline being limited to an operable decline angle range by contact of each of the closed ends of the control slot with the decline control pin. The operable decline range may have a minimum angle of decline of less than about 180° and a maximum angle of decline of greater than about 180°.

The decline control mechanism further may have a friction control mechanism connected to the support frame, the friction control mechanism being adapted to contact and frictionally resist slidable travel of the decline control slot about the decline control pin. The friction control mechanism may have a brake control wheel having a brake surface, the brake control wheel being threadably received on the decline control pin so as to have an axis of rotation centered around the decline control pin; and wherein threadable rotation of the brake control wheel about the decline control pin causes the brake surfaces to contact the trailing arm so as to adjustably and frictionally resist sliding movement of the decline slot of the trailing arm about the decline pin, wherein an amount of the frictional resistance may be controllable by threadable rotation of the brake control wheel.

The decline control pin may be adjustable relative to the decline control slot defined in the trailing arm so that the maximum angle of decline may be varied to provide variable operable decline angle ranges. The decline control mechanism may be connected to the support frame and may have a decline control slot and a decline control knob threadably received on the decline control pin, the decline control slot being configured to receive the decline control pin and the decline control knob adapted to secure the decline control pin to the decline control slot in two or more different decline positions, wherein in each of the two or more different decline positions a position of the decline control pin relative to the decline control slot may be different so that the maximum angle of decline may be different, providing two or more operable decline angle ranges. The decline control pin may be adjustable relative to the decline control slot defined in the trailing is arm so that the maximum angle of decline may be varied to provide variable operable decline angle ranges.

In another embodiment, the first surface of the back rest further may have a lumbar support structure, the lumbar support structure adapted to provide supplemental support to the back of the user. The exercise device may further include at least one hand grip connected to the back rest and adapted to provide grip support for at least one hand of the user when in the exercise position, and/or a foot rest connected to the seat and adapted to provide support for the feet of the user when in the exercise position. The exercise device also may further include a support bar pivotally attached to the support frame and operable to selectively and statically support the back rest at an angle of decline that places the user in a supine position.

In another respect, disclosed is an exercise device, including a back rest having first and second ends; a seat having first and second ends, the first end of the seat being pivotably attached to the second end of the back rest at a device pivot point, wherein a plane of the back rest and a plane of the seat form an angle of decline therebetween; and a support frame pivotally supporting the back rest at a first point positioned between the first and second ends of the back rest, and pivotally supporting the seat at a second point positioned between the first and second ends of the seat; a decline control mechanism, including a trailing arm having first and second ends and a decline control slot defined therein between the first and second ends of the trailing arm, the decline control slot being closed at each end; the first end of the trailing arm being pivotally attached to the extension platform at a point adjacent the device pivot point, a decline control pin connected to the support frame, the decline control pin being received in the decline control slot so that adjustment of the angle of decline causes the decline control slot to slidably travel about the decline control pin, the adjustment of the angle of decline being limited to an operable decline angle range by contact of each of the closed ends of the control slot with the decline control pin, a friction control mechanism including a brake control wheel having a brake surface, the brake control wheel being threadably received on the decline control pin so as to have an axis of rotation centered around the decline control pin; and wherein threadable rotation of the brake control wheel about the decline control pin causes the brake surfaces to contact the trailing arm so as to adjustably and frictionally resist sliding movement of the decline slot of the trailing arm about the decline pin, wherein an amount of the frictional resistance may be controllable by threadable rotation of the brake control wheel, and a decline control knob threadably received on the decline control pin, the decline control slot being configured to receive the decline control pin and the decline control knob adapted to secure the decline control pin to the decline control slot in two or more different decline positions, wherein in each of the two or more different decline positions a position of the decline control pin relative to the decline control slot may be different so that the limits of the angle of decline may be different, providing two or more operable decline angle ranges.

The back rest and the seat together may form an extension platform adapted to receive a user in an exercise position wherein the first surface of the back rest supports an upper back of the user, and wherein the first surface of the seat supports a posterior of the user; and the angle of decline may be adjustable up to a maximum value of from about 180° to about 235°.

The exercise device may further include first and second hand grips connected to the back rest and adapted to provide support for the hands of the user when in the exercise position; a foot rest connected to the seat and adapted to provide support for the feet of the user when in the exercise position; and the first surface of the back rest further may have a lumbar support structure, the lumbar support structure adapted to provide supplemental support to the back of the user. In addition, the exercise device may further include a support bar pivotally attached to the support frame and operable to selectively and statically support the back rest at an angle of decline that places the user in a supine position.

DESCRIPTION OF ILLUSTRATIVE EMBODIMENTS

Figure 1:
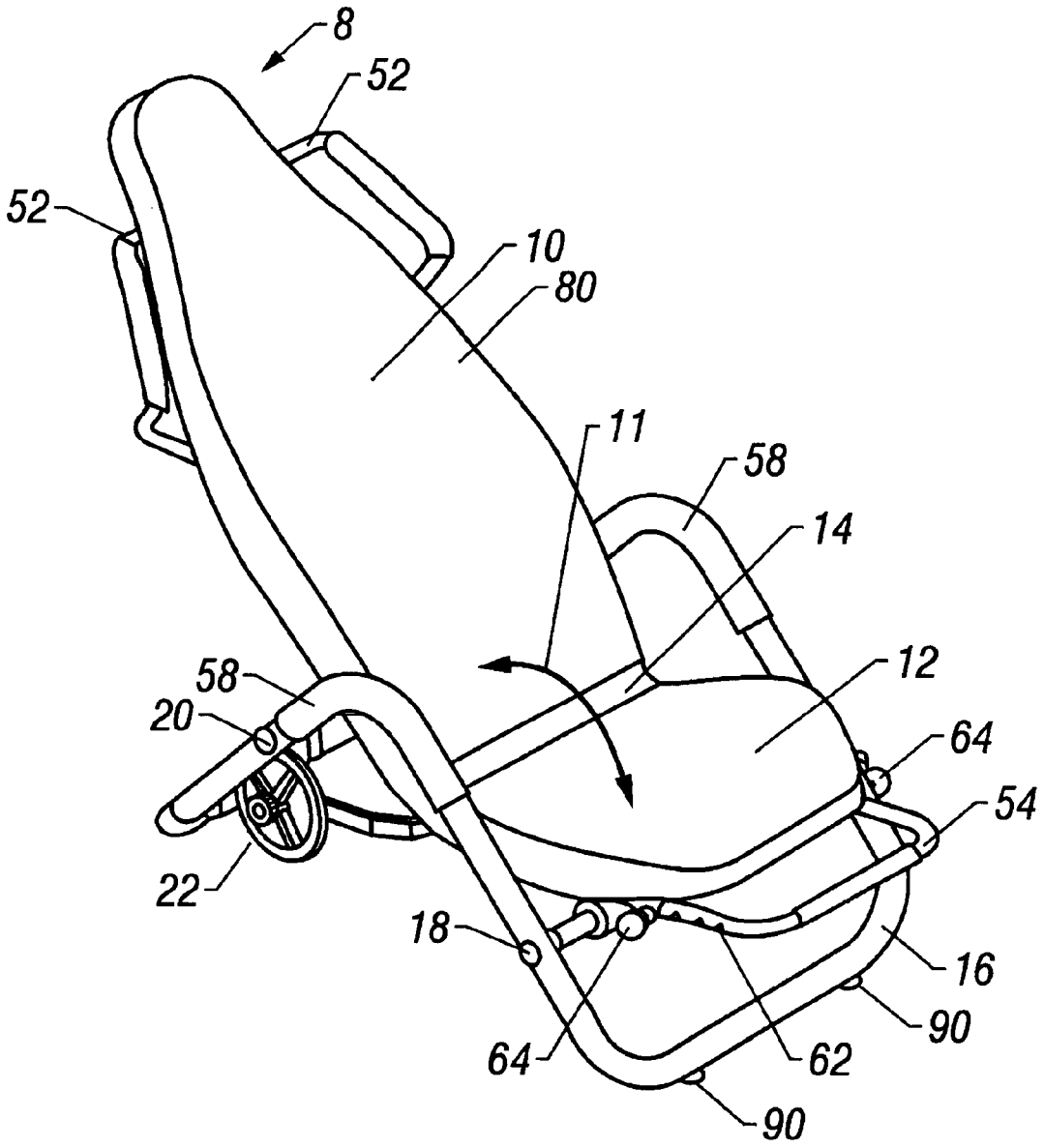
FIG. 1 is a simplified front perspective view of an exercise device according to one embodiment of the disclosed method and apparatus.
Figure 14:
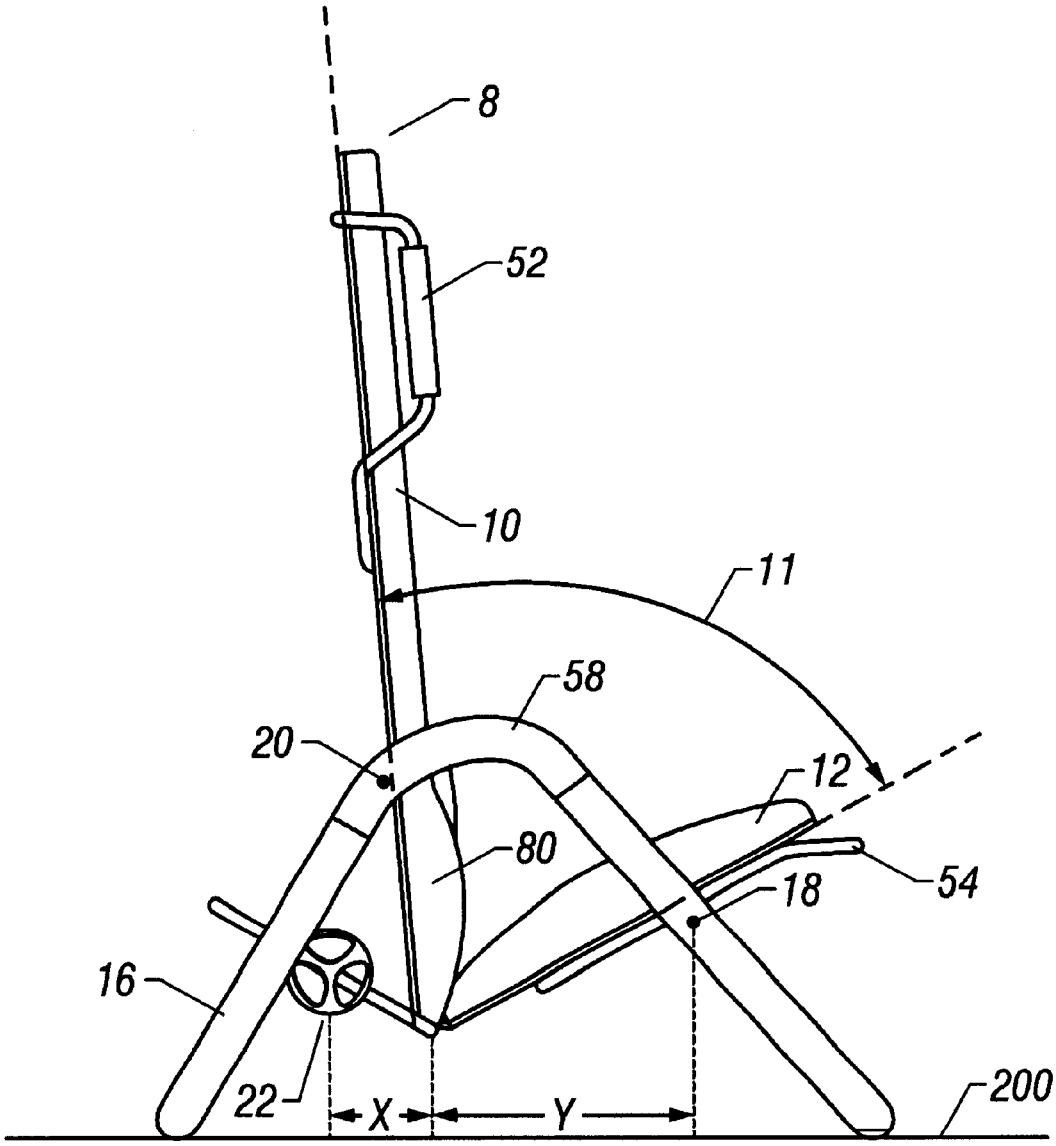
FIG. 14 is a simplified side view of an exercise device according to one embodiment of the disclosed method and apparatus, and showing the exercise device positioned at an angle of extension of about 65°.
Figure 15:
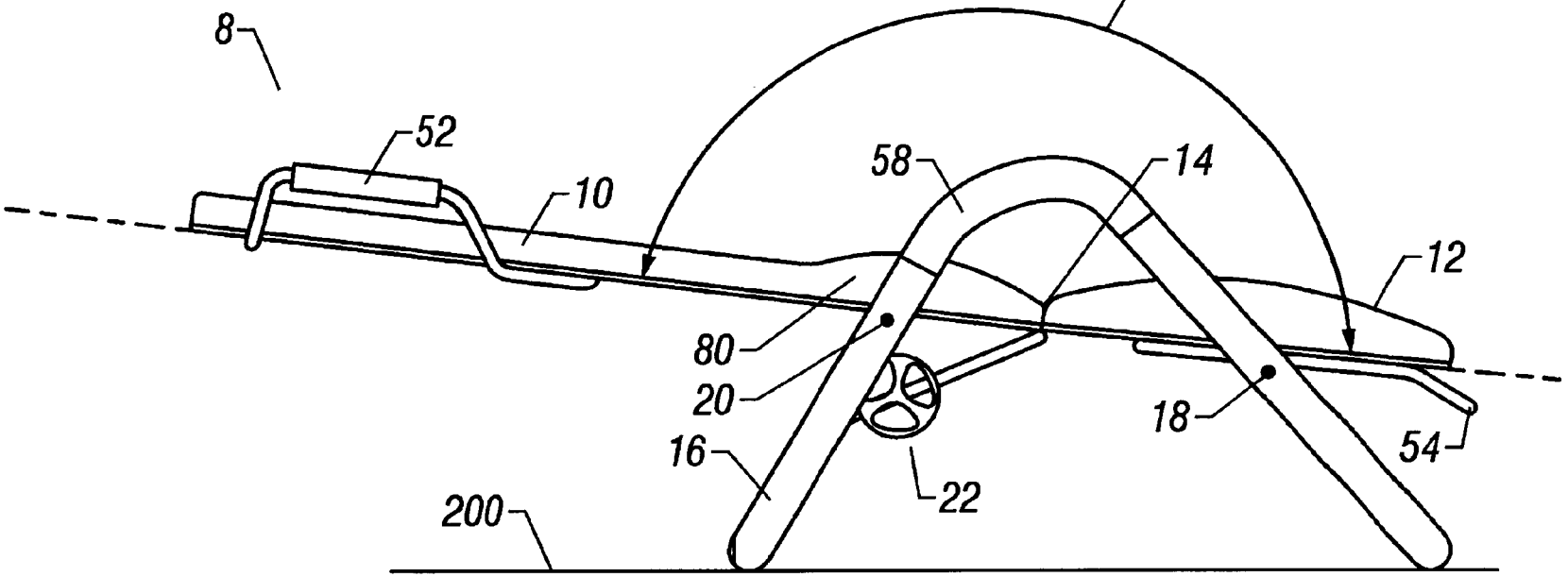
FIG. 15 is a simplified side view of an exercise device according to one embodiment of the disclosed method and apparatus, and showing the exercise device positioned at an angle of extension of about 180°.
Figure 16:
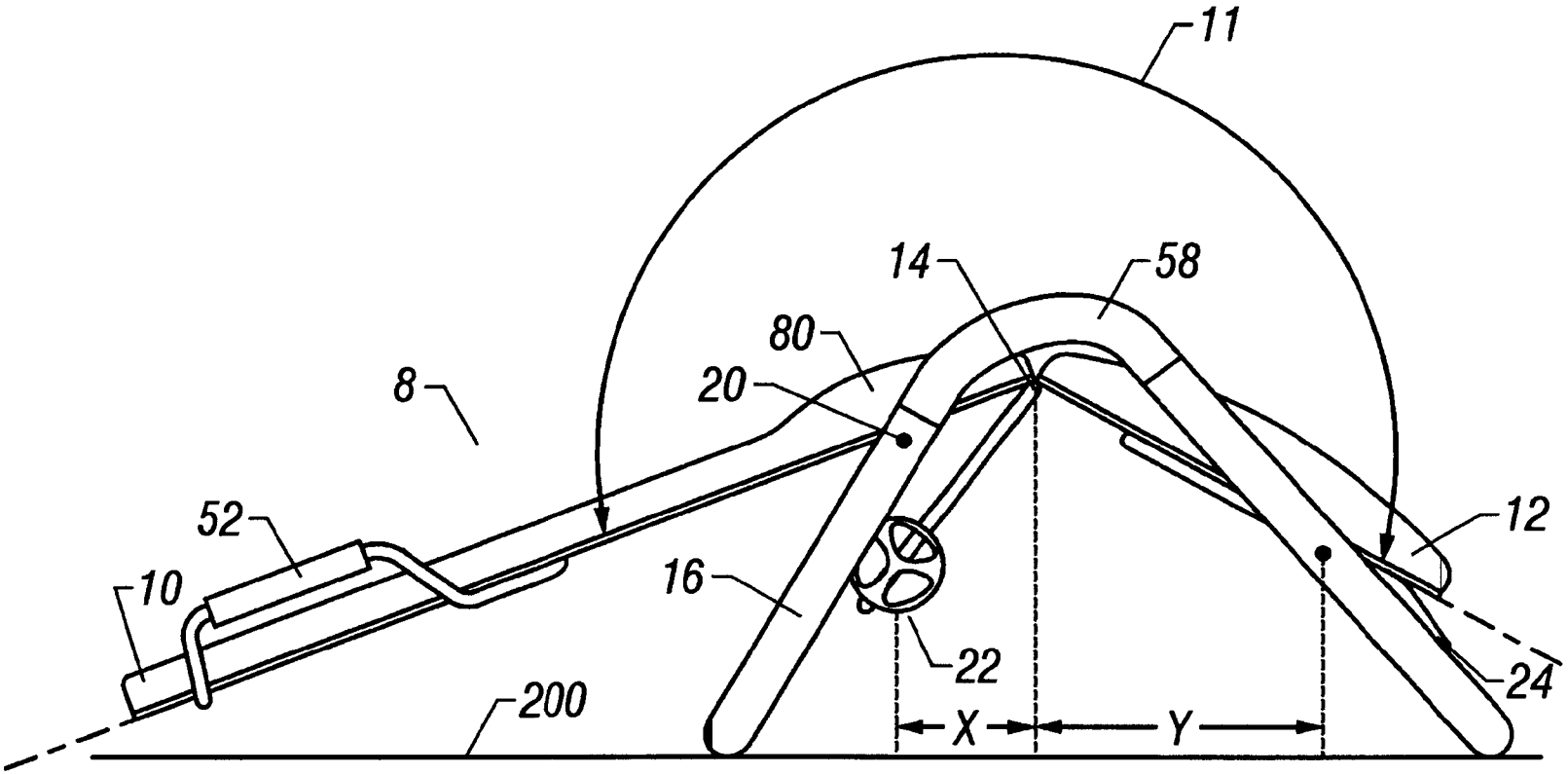
FIG. 16 is a simplified side view of an exercise device according to one embodiment of the disclosed method and apparatus, and showing the exercise device positioned at an angle of extension of about 235°.

FIG. 1 illustrates an exemplary embodiment of the disclosed exercise device which may be used to provide improved strength, flexibility and stability of lumbar and abdominal musculature. As shown in FIG. 1 the device comprises a declinable chair 8 which includes backrest 10 and seat 12 which are pivotally connected at chair pivot point 14. Seat portion 12 and backrest portion 10 may be suitably dimensioned for supporting a human user. Although particular embodiments of a declinable chair are described and illustrated herein, it will be understood with benefit of this disclosure by those of skill in the art that dimensions and shape of the components of declinable chair 8 may be varied in many ways, for example, to suit different body sizes and weights including, but not limited to, for children, professional athletes, adults, etc. In one embodiment, the disclosed exercise device has a declinable chair and attached support frame designed for supporting a user of up to about 300 pounds in weight.

as As shown, declinable chair 8 may be supported by support frame 16, in this case a tubular support frame having the shape of an inverted "V". Chair 8 is shown pivotally supported by frame 16 at two points, seat pivot point 18 and backrest pivot point 20 (which may be more clearly seen in FIGS. 2, 6, 7 and 8). As illustrated in the figures, chair 8 is declinable by virtue of the combination of respective pivotable points 14, 18 and 20. The degree of decline of chair 8 may be measured in terms of the "angle of decline" formed between the plane of seat 12 and the plane of backrest 10. For example, FIG. 14 illustrates chair 8 in a position having an angle of decline 11 of about 65°. FIG. 15 shows declinable chair 8 in a position having an angle of decline 11 of about 180°. FIG. 16 illustrates declinable chair 8 in a position having an angle of decline 11 of about 235°. In this regard, the dashed lines present in FIGS. 14–16 are intended to represent the respective planes of seat 12 and backrest 10.

In the illustrated embodiment, pivot point 14 may be a hinge which serves to pivotally join seat 12 to backrest 10 as shown. Although a hinge is employed in this embodiment, any other suitable device for pivotally joining a seat 12 to a backrest 10 may be employed including, but not limited to, rod/axle configurations, single-piece pliant connectors, etc. Similarly, pivot points 18 and 20 are shown as pivotal rods extending between side frame members of support frame 18 and joined to seat 12 and backrest 10 by fasteners. However, any other suitable manner of pivotally attaching declinable chair 8 to support frame 16 may be employed including, but not limited to, independent rodless pivot point attachments to a support frame (such as via bolts or studs attached to frame 16), etc.

A support frame may be of any material and/or design suitable to support a person or user when in the seated position including, but not limited to, frames constructed of members having a cross-sectional construction of a hollow tube, solid rod, mixtures thereof, etc. In this regard, a frame material may desirably be selected to be relatively rigid so as to support the weight of an individual, as well as to absorb repeated extension movements without fatiguing. Suitable materials for a support frame include, but are not limited to, metal, plastic, wood, fiberglass, mixtures thereof, etc. Furthermore, although an inverted "V" shaped support frame 16 is illustrated, it will be understood that any other suitable support frame configuration and/or shape for pivotally supporting a declinable chair 8 may be employed. For example, a support frame 16 may alternatively be a frame having an "H" shape, "A" shape, inverted "U" shape, etc.

Backrest 10 and seat portion 12 of a declinable chair 8 may be constructed of any suitable material and design suitable to support a person or user when performing extension exercises as described herein. Backrest 10 and/or seat portion 12 may also be padded if so desired, although padding is not necessary. In various exemplary embodiments, back rest 10 and seat portion 12 may be plastic-molded, cushioned with cloth or upholstered-covered foam padding mounted on a rigid support surface (such as flat wood, plastic, fiberglass, metal, etc.), or of any other suitable design. Furthermore, although one embodiment of backrest 10 and seat portion 12 having particular respective flat surface profile shapes of each is illustrated herein, it will be understood with benefit of this disclosure that any other backrest and/or seat flat surface profile shape may be employed that is suitable for supporting a person or user when performing extension exercises as described herein including, but not limited to, rectangular, triangular, oblong, oval, etc.

Figure 7:
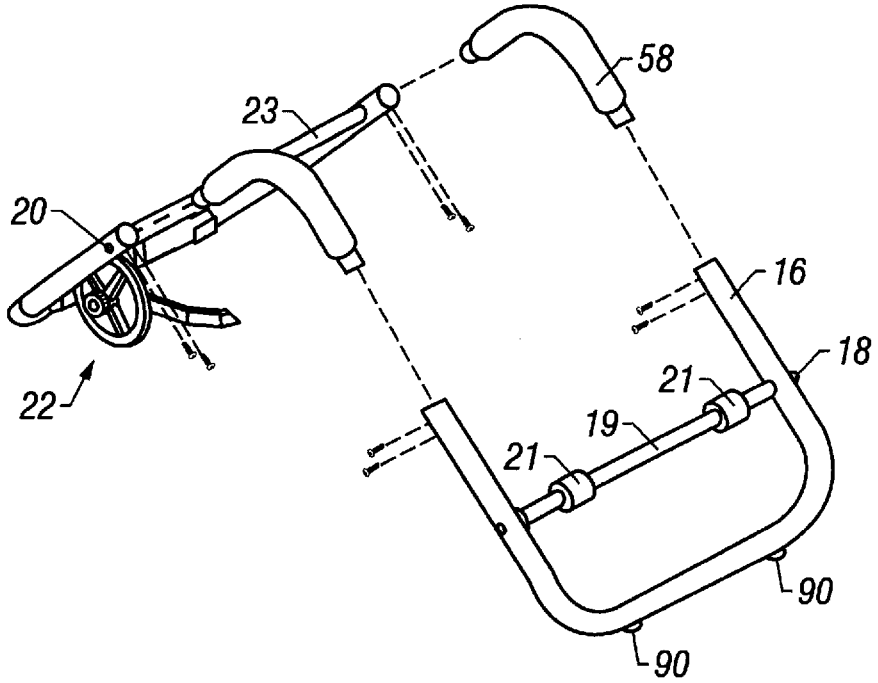
FIG. 7 is a simplified exploded view of a support frame according to one embodiment of the disclosed method and apparatus.
Figure 8:
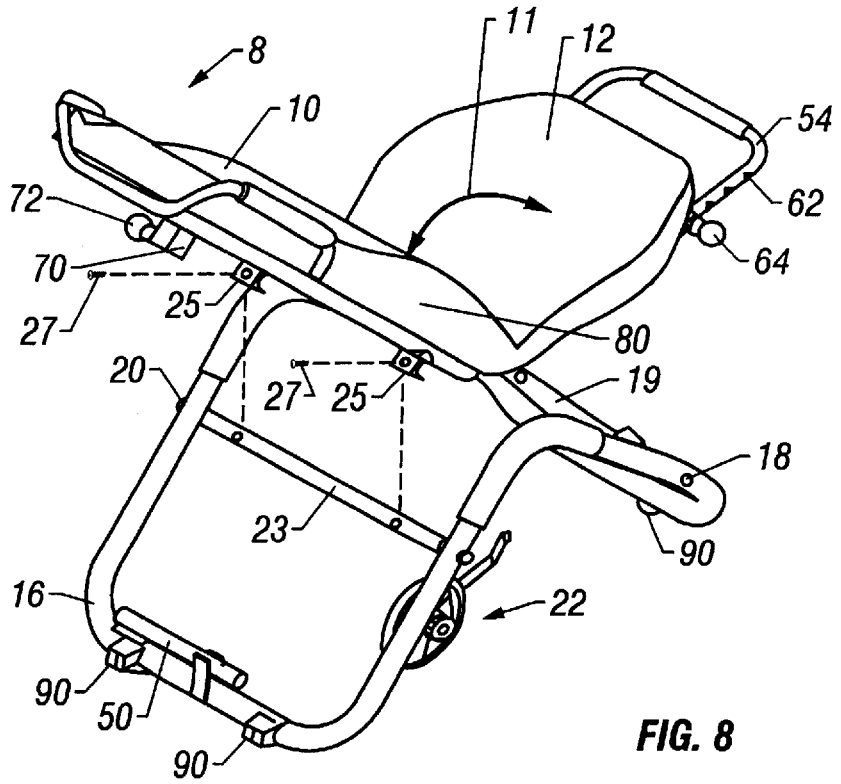
FIG. 8 is a simplified rear exploded view of an exercise device according to one embodiment of the disclosed method and apparatus.

FIGS. 7 and 8 are exploded views of support frame 16 and reclinable chair 8 respectively. In particular, FIG. 7 illustrates seat pivot point 18 which includes pivot bar 19 extending between and attached to tubular side members of tubular support frame 16. Seat pivot bar 19 includes slide points 21 on which the underside of seat 12 may pivot and slide during exercise. FIGS. 7 and 8 also illustrate pivot bar 23 which extends between, and is rotatably attached to, tubular side members of support frame 16 at pivot point 20. Pivot bar 23 is attached to the underside of backrest 10 via attachment points 25, typically with fasteners 27. Thus, during exercise backrest 10 pivots about the axis of pivot bar 23 while seat 12 rotatably slides across slide points 21 of pivot bar 19. Although one exemplary embodiment of pivot points 18 and 20 has been illustrated, it will be understood with benefit of disclosure by those of skill in the art that any suitable mechanism may be employed at each of these points for allowing seat 12 and backrest 10 to pivot in coordinated fashion to allow angle of decline to vary between the operable ranges described herein. For example, pivot bar 19 may or may not be rotatable in relation to frame 16, and likewise pivot bar 23 may be a fixed axle about which one or more attachment points 25 are rotatably or pivotally fixed to allow backrest 10 to pivot about the axis of pivot bar 23.

A declinable chair 8 comprising only a seat 12, backrest 10, and support frame 16 provides an apparatus for exercising and extending the lower back. However, other optional features may be desirable. In this regard, an optional decline control mechanism 22 may also be provided to control the range of adjustment allowed for angle of decline 11, and/or to control resistance to adjustment or changes in angle of decline 11. A decline control mechanism 22 may control either resistance, range of decline angle, or both, and may comprise any mechanism suitable for doing so. For example, a decline mechanism may include springs, mechanical shock absorbers, rubber bands (e.g., bungee-like bands), etc.

Figure 4:
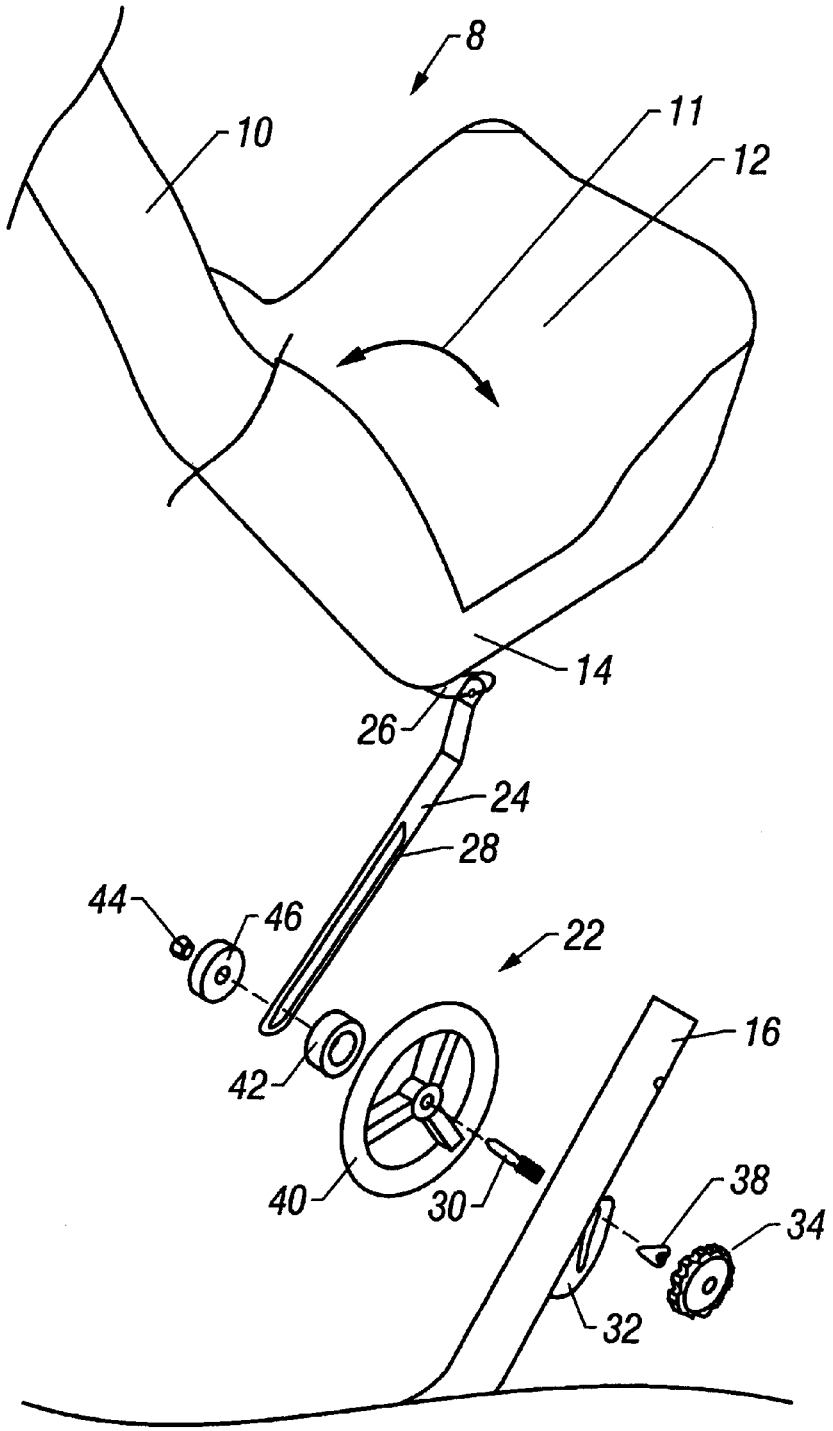
FIG. 4 is a simplified exploded view of the components of a decline control mechanism according to one embodiment of the disclosed method and apparatus.

FIG. 4 illustrates individual components of one exemplary embodiment of decline control mechanism 22. As shown in FIG. 4, decline control mechanism 22 includes a trailing arm 24 pivotably connected to declinable chair 8 at point 26 adjacent pivot point 14. Trailing arm 24 includes a decline control slot 28 defined in the body of trailing arm 24. Decline control slot 28 has closed ends and is dimensioned to receive and to be secured by decline control pin 30 which attaches to support frame 16 at control pin mounting bracket 32. Decline control pin 30 is dimensioned to be slidably received in decline control slot 28, such that its relative position in slot 28 varies with adjustment of the angle of decline 11 of chair 8. Thus, the range of angle of decline 11 is limited by the length of decline control slot 28 by virtue of contact of decline control pin 30 with the closed ends of decline control slot 28. The term "operable decline angle range" refers to the range of different decline angles possible with a reclinable chair 8, with the lower limit of the operable decline angle range being the minimum decline angle and with the upper limit of the operable decline angle range being the maximum decline angle possible. In this exemplary embodiment, absolute minimum and maximum angles of decline achievable by chair 8 are relative to the placement of decline control pin 30.

It will be understood with benefit of this disclosure that by varying the length of decline control slot 28 and/or the position of decline control pin 30, the operable decline angle range as well as the maximum and minimum decline angles may be selectively varied as desired. Furthermore, by providing for adjustment of the relative position of decline control pin 30, the operable decline range may be selectively or adjustably varied by the user. In one embodiment, a maximum angle of decline may be about 180°. In another embodiment, a maximum angle of decline may be greater than about 180°, so as to provide for extension of the back of a user. In another embodiment, maximum angle of decline may be a value from about 180° to less than or equal to about 245°, alternatively from about 180° to less than or equal to about 235°. A minimum angle of decline may similarly vary but in one embodiment may be less than about 180°. In another embodiment, the minimum angle of decline may be from less than or equal to about 180° to greater than or equal to about 60°, alternatively from about 180° to greater than or equal to about 65°. In a further embodiment, the angle of decline may be adjustable throughout an operable decline angle range having a minimum angle and a maximum angle, with the minimum angle being from about 60° to about 180° (alternatively from about 65° to about 180°), and the maximum angle being from about 180° to about 245° (alternatively from about 180° to about 235°). In yet a further embodiment, an operable decline range may have a minimum angle of from about 65° to about 180°, with a maximum angle selectively adjustable between angles of about 180°, about 215° and about 235°. Notwithstanding these exemplary decline angle embodiments, it will be understood by those of skill in the art with benefit of this disclosure that an operable decline angle range, as well as the absolute values of maximum and/or minimum decline angles, may be varied to be outside the above-given ranges (including greater and/or lesser angles) as so desired to meet different applications and users' needs. Furthermore, it will be understood that by varying support frame 16 so as to increase the distance of chair 8 from a floor surface 200, greater maximum angles of decline may be achievable.

As shown in FIG. 4, control pin mounting bracket 32 has a control pin adjustment slot 36 defined therein. Adjustment slot 36 is configured to receive decline control pin 30 which is held in place by decline control pin knob 34. An optional indicator 38 is also provided for referencing the position of knob 34. Decline control pin knob 34 is threadably received by decline control pin 30 and serves to selectively or adjustably secure decline control pin 30 within control pin slot 36. Loosening control pin knob 34 allows decline control pin 30 to be repositioned within slot 36, thus varying the relation of decline control pin 30 to support frame 16 as well as decline control slot 28. This in turn varies the operable decline angle range of reclinable chair 8 by virtue of the connection of trailing arm 24 to point 26 of reclinable chair 8.

Although one embodiment of a decline control mechanism 22 having a decline control pin 30, trailing arm 24, and mounting bracket 32 with control pin slot 36 has been illustrated, it will be understood with benefit of this disclosure that any other method or mechanism suitable for limiting the operable decline angle range of a reclinable chair 8 may be employed. For example, a decline control pin may be fixably attached to a support frame 16 or alternatively may be adjustable or repositionable in relation to a support frame 16 by means other than a control pin adjustment slot 36 including, but not limited to, by multiple mounting holes for receiving a decline control pin in multiple locations.

As shown in further detail in FIG. 4, a decline control mechanism 22 may also include a decline resistance control mechanism, in this exemplary embodiment a friction control mechanism including a brake control wheel 40 and brake surfaces 42 and 46. It will be understood that decline control resistance refers to application of resistance to both declining motion that increases the angle of decline, as well as the opposite return or inclining motion that decreases the angle of decline. Brake control wheel 40 and brake surfaces 42 and 46 are threadably received on decline control pin 30 so that rotation of the brake control wheel 40 causes brake surfaces 42 and 46 to contact trailing arm 24 and frictionally resist sliding movement of decline slot 28 of trailing arm 24 about decline pin 30. Trailing arm 24 may be any material suitably strong or rigid enough for controlling changes in decline angle 11 during exercise by a user (such as steel, plastic, aluminum, etc.). Brake surfaces 42 and 46 may be any material suitable for frictionally interacting with trailing arm 24 to control resistance to changes in decline angle 11 including, but not limited to, plastic, metal, rubber, etc. In one embodiment trailing arm 24 is steel and brake surfaces 42 and 46 are injection molded plastic.

Advantageously, in one embodiment the adjustment of brake control wheel 40 allows a user to selectively control resistance to adjustment or change in the angle of decline 11 during exercise, from virtually no resistance to almost complete resistance to changes in angle of decline 11. Further, in this embodiment brake control wheel 40 may be sufficiently rotated so as to provide sufficient friction via brake surfaces 42 and 46 to completely prevent movement of trailing arm 24 relative to pin 30, thus preventing adjustment of, or change in, the angle of decline 11. Thus, a user is provided with complete control over the exercise process, and may selectively prevent or resist such adjustment at any time. When performing back extension exercises, for example, a new user or beginner may wish to use brake control wheel 40 to impart sufficient friction or resistance so that backrest 10 gently descends. More experienced users may wish to perform the same exercises with control wheel 40 set to provide little or no such friction or resistance. Advanced users may impart sufficient friction during abdominal flexion exercises to increase workload during workout.

As shown in FIG. 4, a decline resistance control mechanism may be operably secured to support frame 16 via bracket 32 and to trailing arm 24 via decline control pin 30, control pin knob 34 and control pin fastener 44. Brake surfaces 42 and 46 are positioned on opposite sides of trailing arm 24 to slidably and frictionally contact trailing arm 24.

It will be understood with benefit of disclosure by those of skill in the art that although one exemplary embodiment of a decline control mechanism 22 has been illustrated in the figures, other configurations and combinations of features are possible. For example, the disclosed exercise device may be configured with a decline control mechanism having only a mechanism to adjustable control operable decline angle range, such as provided by decline control pin 30, mounting bracket 32 and control knob 34. Alternatively, a decline control mechanism 22 including only a friction control mechanism may be provided. In still other embodiments, it is possible to provide a mechanism to only control maximum and minimum decline angle (i.e., a single operable decline angle range), such as would be the case with only a trailing arm 24 and stationary decline control pin 30. In any case, those of skill in the art will understand with benefit of this disclosure that such features may be combined or varied to achieve the desired amount of control for specific users and applications.

Figure 5:
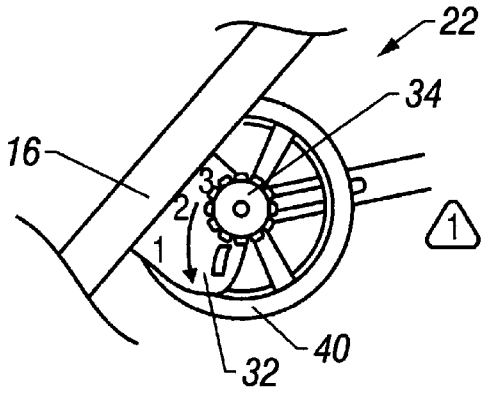
FIG. 5 is an enlarged partial view of a decline control mechanism according to one embodiment of the disclosed method and apparatus.
Figure 6:
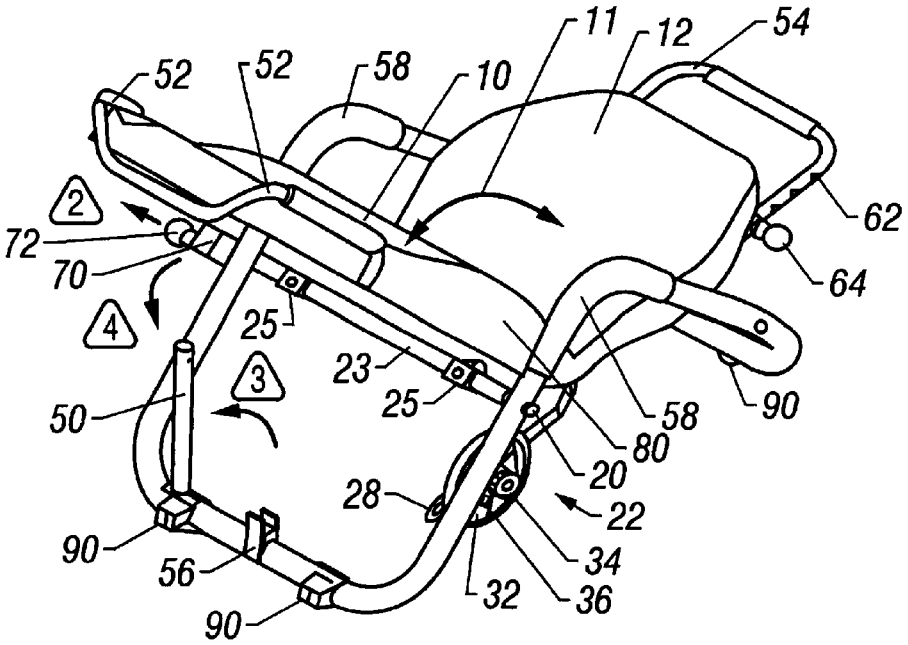
FIG. 6 is a simplified rear perspective view of an exercise device according to one embodiment of disclosed method and apparatus.

FIGS. 5 and 6 provide additional illustration of one exemplary embodiment of decline control mechanism 22. In this regard, FIG. 5 shows a side view of the components of decline control mechanism 22 described above. Also shown in FIG. 5 are optional inscribed position indicators, in this case indicating three positions for decline control pin 30. Indicator 38 is designed to interface with these inscriptions so that the user knows which position has been selected. In the illustrated embodiment FIG. 5, position 1 allows backrest 10 to descend in relation to seat 12 to a point where backrest 10 and seat 12 together form a surface which is essentially flat, corresponding to a decline angle of about 180°. Position 2 allows further descent so as to provide a extension of a user's back, in this case a decline angle of about 215°. Selection of position 3 allows a maximum decline angle of about 235°. The corresponding operable decline angle ranges for the three positions are, respectively, from about 65° to about 180°, from about 65° to about 215°, and from about 65° to about 235°.

Figure 2:
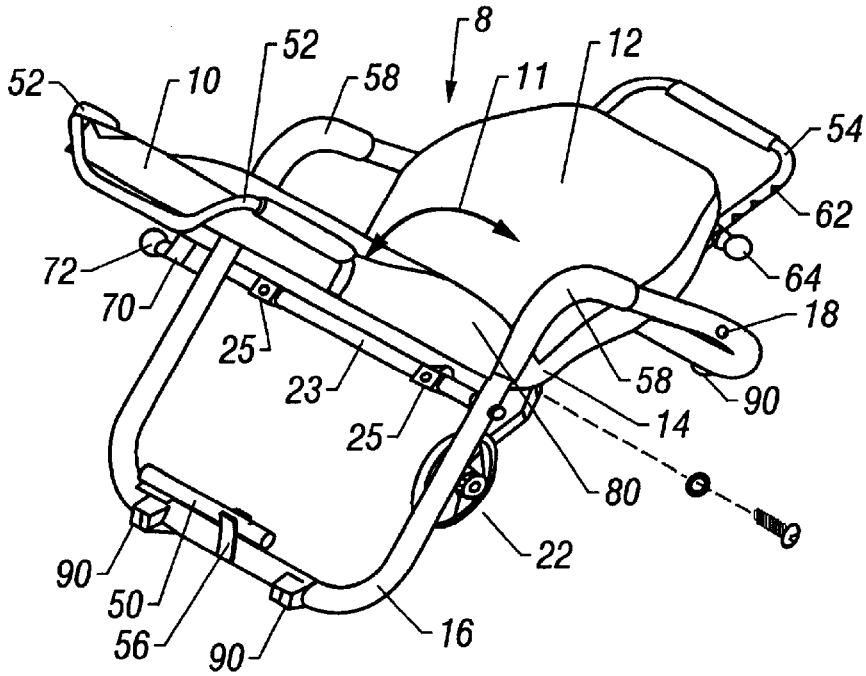
FIG. 2 is a simplified rear perspective view of an exercise device according to one embodiment of the disclosed method and apparatus.
Figure 3:
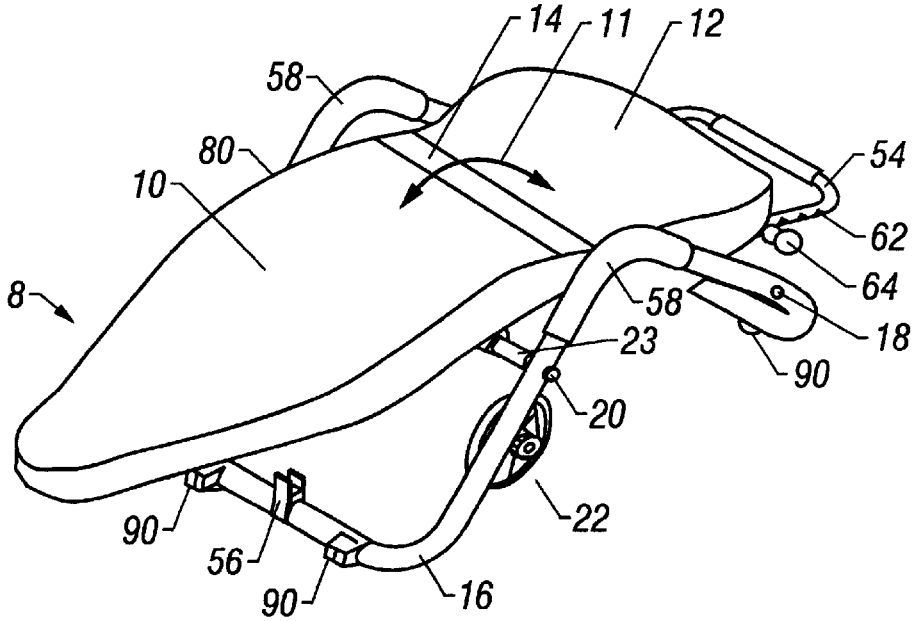
FIG. 3 is a simplified rear perspective view of an exercise device according to one embodiment of the disclosed method and apparatus.

It will be understood with benefit of this disclosure that other optional features and combinations of features may be advantageously employed as so desired. For example, the illustrated embodiment may also employ an optional vertical support bar 50, handgrips 52 and 58, and footrest 54. Support bar 50 is shown pivotally attached to support frame 16 so that it may be alternately stowed in a horizontal position in storage bracket 56 or selectively deployed vertically so as to receive and statically support backrest 10 in horizontal position, i.e., corresponding to a decline angle of about 180°. Advantageously, vertical support bar 50 thus may be used to provide additional support (for example, in conjunction with brake control 40) when it is desired to use reclinable chair 8 as a static flat surface, for example, as a static workout bench for weight lifting or other exercises. In this regard, FIG. 2 shows vertical support bar 50 in stored position. FIG. 6 shows vertical support bar 50 in deployed vertical position and ready to receive and support backrest 10. FIG. 3 shows reclinable chair 8 in flat position and statically supported by vertical support bar 50. Shown in FIG. 8 is vertical support bar attachment point 70 on the underside of backrest 10. Vertical support bar attachment point 70 removably receives vertical support bar 50 and removably secures support bar 50 via spring-loaded locking retaining knob (or "pop-pin") 72 which is received in a hole provided in support bar 50.

Figure 9:
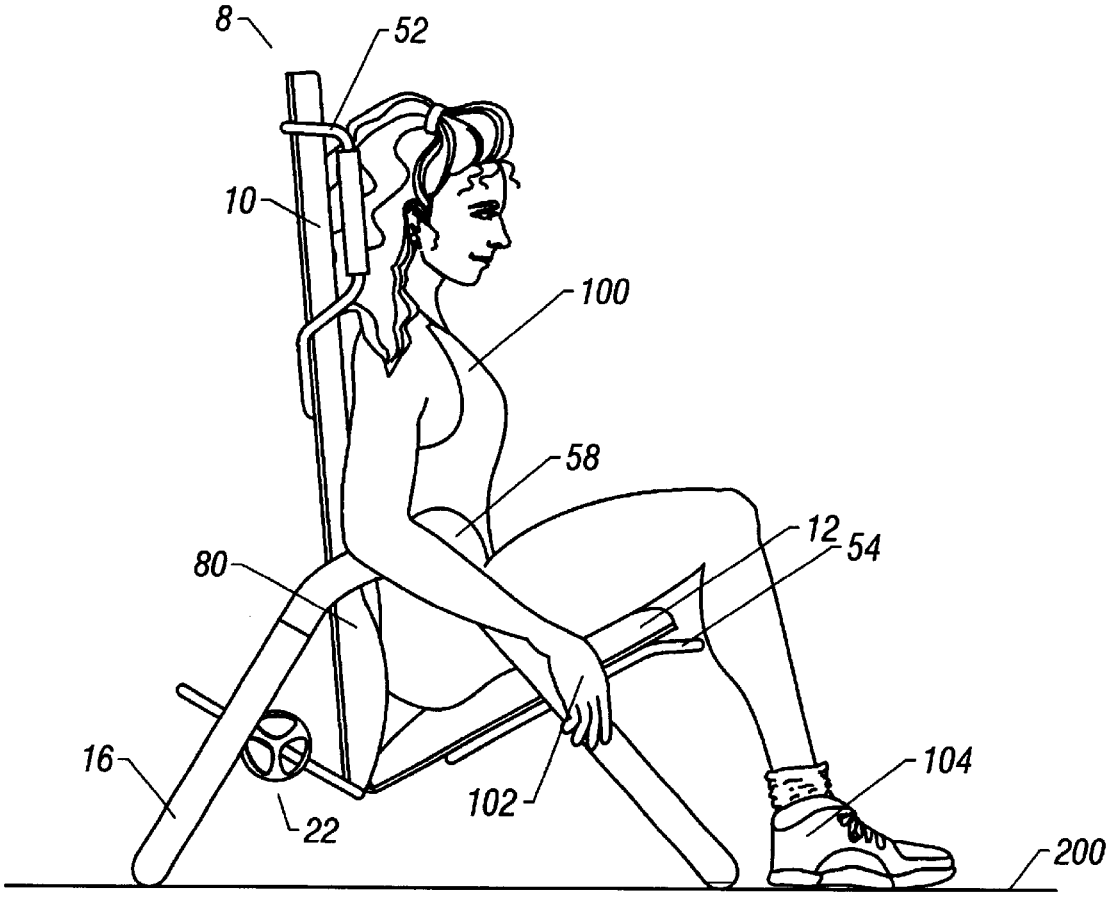
FIG. 9 is a simplified side view of an exercise device according to one embodiment of the disclosed method and apparatus, and showing a user positioned on the exercise device at an angle of extension of about 65°.
Figure 10:
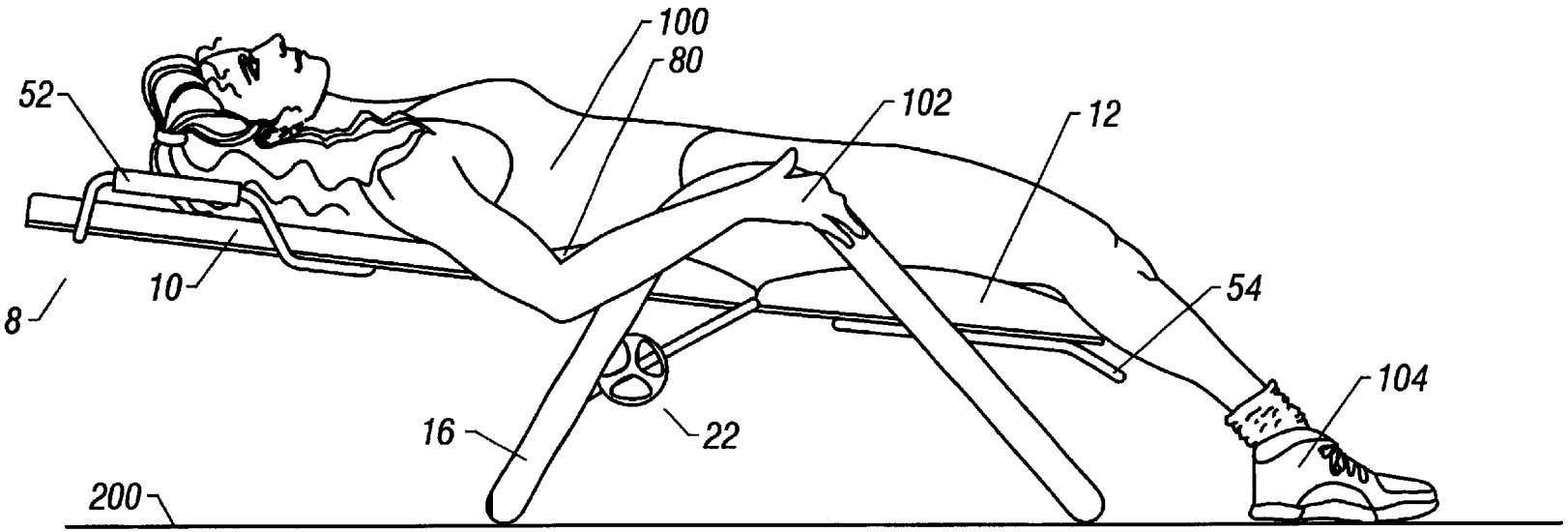
FIG. 10 is a simplified side view of an exercise device according to one embodiment of the disclosed method and apparatus, and showing a user positioned on the exercise device at an angle of extension of about 180°.
Figure 12:
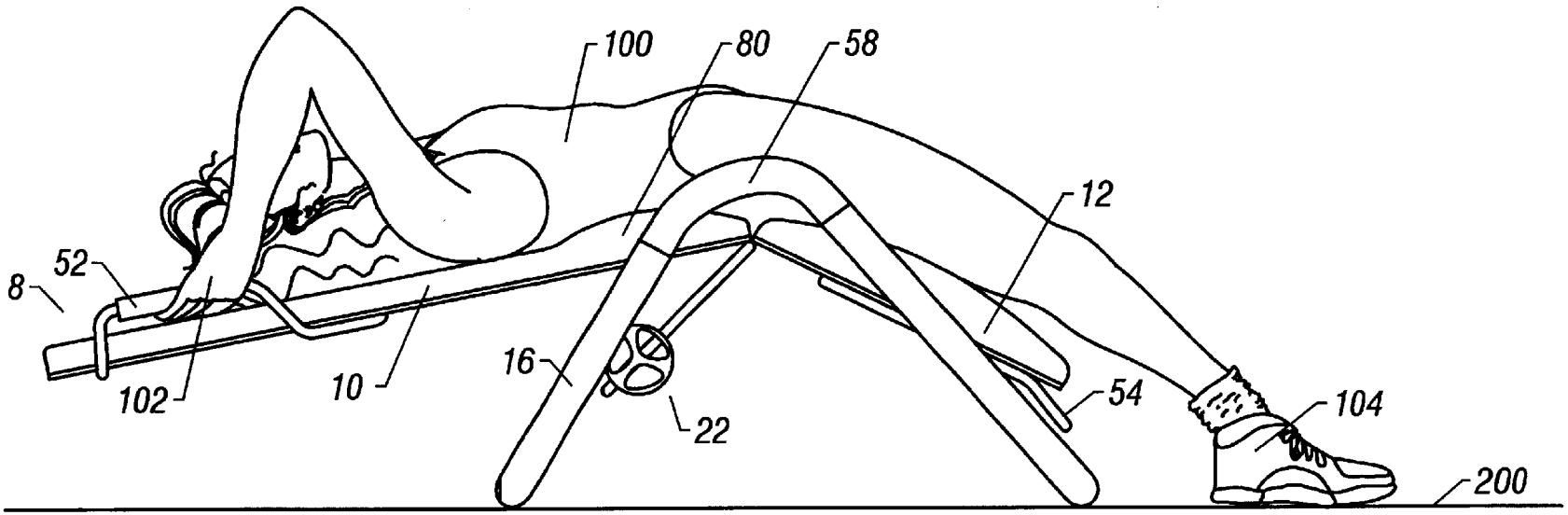
FIG. 12 is a simplified side view of an exercise device according to one embodiment of the disclosed method and apparatus, and showing a user positioned on the exercise device at an angle of extension of between about 180° and about 235°.
Figure 13:
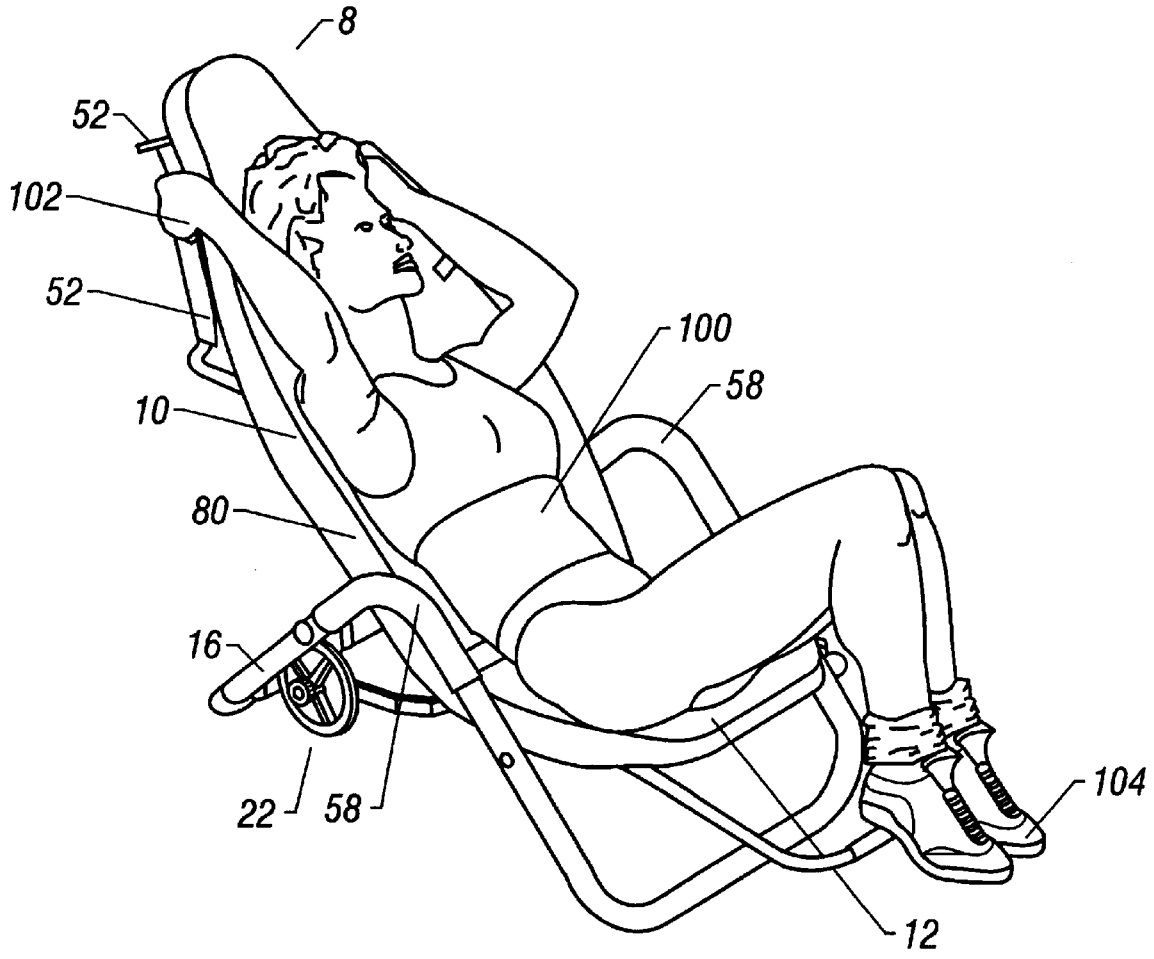
FIG. 13 is a simplified perspective view of an exercise device according to one embodiment of the disclosed method and apparatus, and showing a user positioned on the exercise device and performing abdominal crunches.

As illustrated, support frame handgrips 58 may be provided on support frame 16 as shown in FIGS. 1–3 and 6–8, and may be, for example, foam padding or other suitable handgrip material surrounding tubular frame of support frame 16. In this configuration, handgrips 58 on either side of seat 12 may be employed by the user during the exercise to control the user's body movement. In this regard, a user may use handgrip 58 to help push and pull themselves through the full range of movement (or through the full selected operable decline angle range), as shown in FIGS. 9 and 10. As further illustrated, optional handgrip areas 52 may be provided for use during exercising such as shown in FIGS. 12 and 13, thus providing a user with alternate positions for performing, for example, more advanced exercises and/or abdominal exercises such as crunches. Handgrips 52 are shown positioned on opposite sides of backrest 10 and may be grasped on either side of a user's head during exercise. As such, handgrips 52 may allow a user's arm strength to compensate or assist other weak muscles by pulling on the handgrips 52. It will be understood, however, that neither handgrips 52 nor 58 are necessary for performing exercises using the disclosed exercise device. Handgrips 52 may or may not be padded (such as with foam or other suitable handgrip material). It will be understood with benefit of this disclosure that the configuration and location of handgrips 52 and/or 58 may be varied in a number of ways, for example a single overhead bar may be attached on top of backrest 10 in addition to or instead of separate handgrips 52.

Also illustrated is optional footrest 54. In this case, footrest 54 is slidably adjustable inwards and outwards by means of position holes 62 and pop-pins 64. Footrest 54 provides support for a user's feet during extension exercises as shown in FIG. 13. However, it will be understood with benefit of this disclosure that footrest 54 is not necessary and the exercises may be performed with the user's feet on a floor surface 200 instead, as shown in FIGS. 9–12. Furthermore, it will be understood that a footrest need not be adjustable and may have different configurations suitable for supporting a user's feet during exercise. A footrest may or may not be padded or provided with a non-skid surface such as rubber, etc.

Other optional features which may be advantageously employed include a lumbar support structure 80 for providing supplemental support to the back of a user during exercise. As may be seen in the figures, lumbar support structure 80 may be configured as a raised area within backrest 10 for providing additional support to the lumbar area of a user during exercise. Those of skill in the art will understand with benefit of this disclosure that a lumbar support structure 80 may be configured in different sizes and shapes known in the art. In one embodiment, lumbar support structure may be a thickened area of foam padding within a foam padded backrest as described elsewhere herein, although any other material suitable for supporting a user's back may be employed (including a solid insert in a padded backrest, a shaped raised area in a molded plastic backrest, etc.).

Other optional features include optional support frame wheels 90 which may be provided for ease of transportation or movement of the disclosed exercise device by one person. With benefit of this disclosure such wheels may be of any configuration (or alternatively may be skids, for example) known in the art and suitable for transporting the disclosed exercise device.

FIGS. 9–13 illustrate a user 100 in exercise position on declinable chair 8. As illustrated, the head, upper and lower back of user 100 are in contact with and supported by backrest 10. The buttocks and thighs (or posterior of user 100) are in contact and is supported by seat 12. Optional lumbar support area 80 is positioned to be in contact with the user's lower back. FIG. 9 shows user 100 in a seated position in declinable chair 8.

Figure 11:
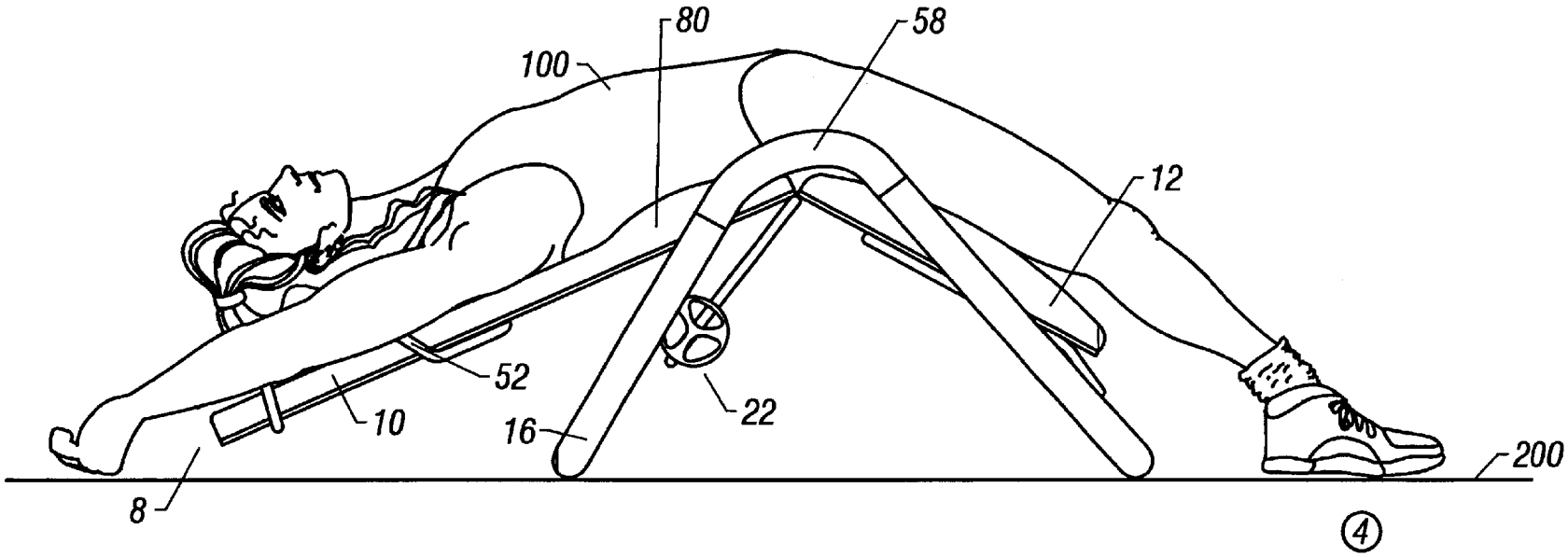
FIG. 11 is a simplified side view of an exercise device according to one embodiment of the disclosed method and apparatus, and showing a user positioned on the exercise device at an angle of extension of about 235°.

FIGS. 9–11 illustrate one exemplary embodiment of back extension exercises which may be performed using the disclosed declinable chair 8 by user 100. As shown in FIG. 9, user 100 may begin in a seated position in declinable chair 8, the angle of decline of declinable chair 8 being about 65°. If so desired, when a user mounts the device, the decline angle may be locked in seated position using decline control mechanism 22 (when present) to make mounting easier. Although FIG. 9 shows a user 100 in seated position on a declinable chair 8 having an angle of decline of about 65°, it will be understood with benefit of this disclosure that a decline angle of chair 8 may vary and be greater than or less than about 65° when a user 100 is in seated position, depending on configuration of declinable chair and/or body characteristics of a specific user. As shown in FIGS. 9–11, for back extension exercises hands 102 of user 100 are typically positioned such that the arms and hands of user 100 do not play a significant role in the exercise motion, thus giving muscles of the lower back a greater workout. As shown in FIGS. 9–11, feet 104 of user 100 may be positioned on a floor surface 200 for support during back extension exercises, although feet 104 may alternately be positioned on footrest 54 so as to further workout the muscles of the lower back, typically by more experienced users. When feet 104 are positioned on the floor, user 100 may "walk" them out and away from the device while pushing backwards on backrest 10, as shown in the figures.

To effect back exercises, user 100 may utilize lumbar muscles of the lower back to pivot backrest 10 in relation to seat 12 so as to increase the angle of decline as illustrated in FIGS. 10 and 11. This may be accomplished, for example, by gradually releasing decline control mechanism 22 (when present and in initially locked position) and pushing backwards. In this regard, FIG. 10 illustrates user 100 on declinable chair 8 which has been pivoted by the back muscles of user 100 to an angle of decline of about 180°. Using one embodiment of the disclosed device, a user 100 may adjust resistance to change in angle of decline during such pivoting motion using, for example, a decline control mechanism 22 as described elsewhere herein.

In one exemplary embodiment for using the disclosed device, user 100 may begin back extension exercises with hands 102 on hand grips 58 and feet 104 on a floor surface 200. User 100 maintains hands 102 on grips 58 as backrest 10 descends from seated starting position to a relatively flat position (or about 180°) as shown in FIGS. 9 and 10, "walking" feet 104 outward from the device as this occurs. User 100 then may stretch their arms behind their head as backrest 10 further descends to extend the spine (as shown in FIG. 11). The maximum decline angle may be held for a period of time (such as about 20–30 seconds). User 100 may then position hands 102 on handgrips 58 while contracting abdominal and buttocks muscles and "walking" feet 104 backward toward the device to cause the angle of decline to decrease to between about 65° and about 180°. This process may be repeated any number of times, as desired. Typically, user 100 does not return to completely to the seated starting position, until finished with the back exercises.

FIG. 11 illustrates user 100 on declinable chair 8 in a position having an angle of decline of about 235° and resulting in full or partial extension of the lumbar muscles of user 100. User 100 may achieve this position by contraction of the lumbar muscles so as to move backrest 10 in relation to seat 12 from the 180° to the 235° angle of decline illustrated in FIG. 11.

To complete a back extension exercise, user 100 may contract abdominal muscles so as to push the buttocks downward and pivot backrest 10 relative to seat 12 in a manner essentially reverse or opposite to that previously described in relation to FIGS. 9–11.

Although an angle of decline of about 235° is illustrated in FIG. 11, it will be understood that extension of the spine of a user 100 may be achieved with any maximum angle of decline that results in bending of the spine backwards through contraction of the lumbar extensor muscles, including maximum angles of decline greater than or less than 235°. It will also be understood that benefits of the disclosed exercise device may be achieved by a user without extension of the spine, for example, in embodiments is having a maximum angle of decline of about 180° or less. For example, using one embodiment of the disclosed device, one or more different maximum decline angles may be selected by a user by use of decline control mechanism 22 as described elsewhere herein. In this regard, it will be understood that decline control mechanism 22 and/or other components of a declinable chair 8 may be configured to achieve maximum decline angle of greater than or less than about 235°, as so desired. In another possible embodiment, a device may be constructed to have a non-adjustable maximum angle of decline of predetermined value.

As illustrated and described above, back extension exercises may be performed with little, if any, assistance from hands and arms of a user. This is true when pivoting declinable chair 8 in a direction increasing the angle of decline, and/or when moving pivoting chair 8 in the opposite direction to decrease the angle of decline. In this way, during exercise the muscles of the lower back perform the majority of the work, and therefore receive most of the benefits of the exercise. However, it will be understood with benefit of this disclosure that any amount of assistance may be provided by a user's arms or hands, for example, by gripping optional hand grips 52 and/or optional support frame handgrips 58 during back extension exercise.

Also as described above, feet 104 of a user 100 may be placed on optional footrest 54 throughout the exercise so that lower back muscles of a user 100 are primarily responsible for substantially all of the movement of declinable chair 8 throughout the reciprocating angles of decline during back extension exercises. In this regard, since more strength is required from the back muscles when feet 104 are placed on footrest 54 during exercise, footrest 54 is typically used by more experienced and/or stronger users.

FIGS. 12 and 13 illustrate a user 100 in exercise position on a declinable chair 8 with hands 102 gripping handgrips 52 for assistance during exercise, for example, when performing sit-ups or abdominal crunches. In FIG. 13, feet 104 of user 100 are shown placed on footrest 54. In FIG. 12, feet 104 of user 100 are shown in contact with a floor surface 200 for support. Thus, it may be seen that a user 100 may avail themselves of, and/or vary, any combination of footrest 54, handgrips 102, and/or support frame handgrips 58 during exercise. Advantageously, by varying position of the hands and feet, as well as by varying resistance to change in decline angle (using, for example, decline control mechanism 22), a user may tailor exercises to address particular muscle groups such as the abdominals, obliques, and/or lower back.

For example, looking to FIGS. 12 and 13, it may be seen that by varying the amount of pull or force exerted by the arms of user 100 through hands 102 to handgrips 52, user 100 may control how much of the exercise motion is caused by the lumbar muscles of the lower back versus the abdominal muscles. In addition, user 100 may concurrently increase resistance to change in decline angle utilizing decline control mechanism 22 in a manner as previously described herein. Should user 100 wish to focus exercise motion on the abdominal muscles rather than the muscles of the lower back, more force may be exerted by user 100 through the arms and hands 102 on handgrips 52. To work the abdominal muscles even more, decline control mechanism 22 may be adjusted so as to offer increased resistance and changes in decline angle.

Advantageously, the disclosed device may be utilized to perform a variety of different exercises, including variations on exercises described herein as well as additional exercises not described. For example, abdominal "crunch" exercises may be performed on one embodiment of the disclosed device as follows. A maximum decline angle of about 180° may be selected, for example, using control pin knob 34 of decline control mechanism 22. Reclinable chair 8 may be locked in seated position for mounting, for example, using brake control wheel 40. User 100 may then sit on reclinable chair 8 with the back of user 100 against backrest 10 and with feet 104 flat on the floor in front of user 100. User 100 may then release brake control wheel 40 with one hand while holding onto handgrips 52 with the other hand, and "walk" feet 104 out while allowing backrest 10 to descend in a controlled manner. Then, to perform a crunch, user 100 may tighten the buttocks and contract the abdominal muscles, lifting the body and the backrest to a comfortable height (usually not fully upright) as shown in FIG. 13. This raised position may be held using the abdominal contraction for a period of time (such as 3 seconds or more), before allowing backrest 10 to descend and repeating the process.

A "knee up" crunch exercise may be performed in essentially the same manner as described above for a crunch, with the exception that user 100 places feet 104 on foot rest 54 during the exercise, and brings one knee toward the chest when backrest 10 is raised during the abdominal contraction. The knee is lowered each time the backrest 10 descends, and may be alternated with the other knee from repetition to repetition.

Side lateral extension exercises may be performed by a user 100 while lying on their side with one shoulder against backrest 10 and while grasping handgrip 52 with hand 102 closest to backrest 10. A user 100 may mount declinable chair 8 in such a position with the angle of decline locked at, for example, about 215°. The angle of decline may be locked in this manner, for example, using brake control wheel 40 of decline control mechanism 22 (when present). Once in position, user 100 may slowly press their upper body against backrest 10 while releasing brake control wheel 40 to cause backrest 10 to descend. As backrest 10 descends, the hips of user 100 will tend to shift upward. Once backrest 10 has descended to a desired preset maximum angle of decline (set, for example, using control pin knob 34), user 100 may extend their free arm up and over their head, typically holding this position for a period of time (such as 20 to 30 seconds). User 100 may then return their free arm to their side and repeat the stretch exercise again on the same side or by rolling over and repeating the exercise on the other side.

In another exemplary embodiment, prone extension exercises may be performed. Prior to beginning exercise, user 100 may select a desired preset maximum angle of decline, for example, an angle of decline greater than about 180°. Such an angle may be set, for example, using control pin knob 34 of decline control mechanism 22 (when present). The declinable chair is then locked in this maximum decline angle position (such as by using brake control wheel 40) for mounting of the device by user 100. User 100 may then mount declinable chair 8 in a position facing chair 8 and grasp side handgrips 58 with both hands, gradually kneeling with both knees on the seat and lowering themselves to lie face down on declinable chair 8 so that the hips of user 8 are positioned over pivot point 20 of declinable chair 8. The next movement of this exercise may be performed with hands 102 on a floor surface 200 beside the backrest 10 if so desired. User 100 may then release brake control wheel 40 to allow declinable angle 11 of declinable chair 8 to decrease. User 100 may then gently contract their lower back muscles so that the body of user 100 rises to a substantially flat position, using their arms and hands 102 against the floor surface 200 if necessary to help push themselves upwards. This position may be held for a period of time (such as about 30 seconds). User 100 may then return to the starting position in a slow and controlled manner, and repeat this process a number of times as desired.

Other exercises that may be performed using the disclosed exercise device include, but are not limited to, exercises performed on reclinable chair 8 when decline angle is locked in substantially flat position, or at about 180°, as described elsewhere herein. A few examples of such exercises include chest presses, chest flys, pullovers, dumbbell rows, tricep kickbacks, seated bicep curls, etc.

In one exemplary embodiment illustrated in FIG. 17, the disclosed exercise device may be configured to have a declinable chair 8 which may be pivoted by a user 100 from a seated position (such as that shown in FIG. 9) to a position of greater decline angle (such as that shown in FIG. 11) in a smooth and fluid movement, and which also has a tendency or propensity to return to the seated position with relatively little resistance. When so configured, a user 100 may advantageously return to the seated position by, for example, grabbing support frame handgrips 58 (as illustrated in FIG. 10 ) and slightly pulling on arm grips 58 so as to initiate downward pivoting of declinable chair 8, and downward movement of the lower back of a user 100, so that declinable chair 8 returns to the initial starting position of FIG. 9. Although resistance of pivoting motion of declinable chair 8 may be controlled using decline control mechanism 22, it will be understood that absent such additional resistance, only minimal resistance exists in this embodiment and declinable chair 8 has a natural propensity to return to a seated position. Such a propensity is advantageous as it allows a beginning or injured user to perform extension exercises with minimum strain on the muscles of the lower back. It will be understood, however, that such a propensity to return to seated position is an optional feature, and need not be present.

Although minimal resistance to change in decline angle and propensity to return to seated position may be imparted using active mechanisms (such as springs, rubberbands, etc.), it may also be advantageously achieved by the design and interrelation of support frame 16 and declinable chair 8. In this regard, declinable chair 8 may be dimensioned and interrelated as illustrated in the figures to achieve a smooth fluid movement of declinable chair 8 throughout varying angles of decline, as well as an ease of motion as declinable chair 8 pivots and returns to the seated position.

For example, referring to the exemplary embodiment illustrated in FIGS. 14–16, pivot points 18 and 20 may be located on support frame 16 so as to be positioned about 8" and about 11", respectively, above a floor surface 200 when frame 16 is positioned on floor surface 200. In this embodiment, pivot points 18 and 20 may be horizontally spaced apart by about 18.5 inches, as indicated by the total of the distances marked "X" and "Y" on FIGS. 14–16. In this embodiment, as shown in FIG. 14, chair 8 may be configured and attached to support frame 16 so that chair pivot point 14 is spaced in a horizontal direction from backrest pivot point 20 by an "X" distance of about 3.5 inches and spaced in a horizontal direction from seat pivot point 18 by a "Y" distance of about 15 inches when chair 8 is in a position with an angle of decline of about 65°. In this position chair pivot point 14 is located about 4 inches above floor surface 200. In the same embodiment, as shown in FIG. 15, pivot point 14 is spaced in a horizontal direction from backrest pivot point 20 by an "X" distance of about 7.5 inches and spaced in a horizontal direction from seat pivot point 18 by a "Y" distance of about 11 inches when chair 8 is in a position with an angle of decline of about 180°. In this position chair pivot point 14 is located about 10.5 inches above floor surface 200. In the same embodiment, as shown in FIG. 16, chair pivot point 14 is spaced horizontally from backrest pivot point 20 by an "X" distance of about 6.5 inches and spaced in a horizontal direction from seat pivot point 18 by a "Y" distance of about 12 inches when chair is in a position with an angle of decline of about 235°. In this position chair pivot point 14 is located about 14.5 inches above floor surface 200.

Although particular and exemplary embodiments of the disclosed exercise device and exercises performed thereon have been described and illustrated herein, it will be understood with benefit of this disclosure by those of skill in the art that various modifications in limits and resistance to changes of angle of decline, as well as various positions of a user's body, feet and hands in a variety of ways so as to achieve varying degrees of exercise (such as to suit a particular individual), as well as to focus on different muscle groups, e.g., the lower back, abdominals and obliques.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents and alternatives falling within the spirit and scope of the invention as defined by the appended claims. Moreover, the different aspect of the disclosed methods and apparatus may be utilized in various combinations and/or independently. Thus, the invention is not limited to only those combinations shown herein, but rather may include other combinations.

What is claimed is:

1. An exercise device, comprising:

a back rest having a first surface and first and second ends;

a seat having a first surface and first and second ends, said first end of said seat being disposed adjacent said second end of said back rest, wherein a plane of said back rest and a plane of said seat define an angle of decline between said first surface of said back rest and said first surface of said seat; and a support frame supporting said back rest and said seat, wherein said back rest and said seat are pivotally movable relative to each other so that said angle of decline is adjustable; and a decline control mechanism, said decline control mechanism including a friction control mechanism and being operable to limit adjustment of said angle of decline, wherein said decline control mechanism is operable to resist adjustment of said angle of decline.

2. The exercise device of claim 1, wherein said back rest and said seat together are adapted to receive a user in an exercise position wherein said first surface of said back rest supports an upper back of said user, and wherein said first surface of said seat supports a posterior of said user.

3. The exercise device of claim 1, wherein said angle of decline is adjustable from an angle of less than about 180° to an angle of greater than about 180°.

4. The exercise device of claim 1, wherein said angle of decline is adjustable between a minimum angle and a maximum angle, said minimum angle being from about 65° to about 215°, and said maximum angle being from about 180° to about 235.

5. The exercise device of claim 1, wherein said decline control mechanism is operable to limit adjustment of said angle of decline to a maximum decline angle of from about 180° to about 235°.

6. The exercise device of claim 1, wherein said decline control mechanism is operable to selectively prevent or resist adjustment of said angle of decline.

7. The exercise device of claim 1, wherein said decline control mechanism is selectively operable to limit adjustment of said angle of decline to at least two different operable angle ranges.

8. An exercise device, comprising:

a back rest having first and second ends;

a seat having first and second ends, said first end of said seat being pivotably attached to said second end of said back rest at a device pivot point, wherein a plane of said back rest and a plane of said seat form an angle of decline therebetween; and a support frame pivotally supporting said back rest at a first point positioned between said first and second ends of said back rest, and pivotally supporting said seat at a second point positioned between said first and second ends of said seat; and a decline control mechanism including a friction control mechanism and operable to limit a range of adjustment of said angle of decline, operable to resist adjustment of said angle of decline, or both;

wherein said back rest and said seat together form an extension platform capable of receiving a user in an exercise position wherein said first surface of said back rest supports an upper back of said user, and wherein said first surface of said seat supports a posterior of said user; and wherein said angle of decline is adjustable up to a maximum value of from about 180° to about 235°.

9. The exercise device of claim 8, wherein said maximum angle of decline is sufficient to cause extension of the back of said user when said user is received by said first surfaces of said back rest and said seat.

10. The exercise device of claim 8, wherein said angle of decline is adjustable between a minimum angle and said maximum angle, said minimum decline angle being from about 65° to about 180°.

11. The exercise device of claim 8, further comprising a decline control mechanism, wherein said decline control mechanism comprises:

a trailing arm having first and second ends and a decline control slot defined therein between said first and second ends of said trailing arm, said decline control slot being closed at each end; said first end of said trailing arm being pivotally attached to said extension platform at a point adjacent said device pivot point; and a decline control pin connected to said support frame, said decline control pin being received in said decline control slot so that adjustment of said angle of decline causes said decline control slot to slidably travel about said decline control pin, said adjustment of said angle of decline being limited to an operable decline angle range by contact of each of said closed ends of said control slot with said decline control pin.

12. The exercise device of claim 11, wherein said operable decline range comprises a minimum angle of decline of less than about 180° and a maximum angle of decline of greater than about 180°.

13. The exercise device of claim 11, wherein said decline control mechanism further comprises a friction control mechanism connected to said support frame, said friction control mechanism being adapted to contact and frictionally resist slidable travel of said decline control slot about said decline control pin.

14. The exercise device of claim 13, wherein said friction control mechanism comprises a brake control wheel having a brake surface, said brake control wheel being threadably received on said decline control pin so as to have an axis of rotation centered around said decline control pin; and wherein threadable rotation of said brake control wheel about said decline control pin causes said brake surfaces to contact said trailing arm so as to adjustably and frictionally resist sliding movement of said decline slot of said trailing arm about said decline pin, wherein an amount of said frictional resistance is controllable by threadable rotation of said brake control wheel.

15. The exercise device of claim 13, wherein said decline control pin is adjustable relative to said decline control slot defined in said trailing arm so that said maximum angle of decline may be varied to provide variable operable decline angle ranges.

16. The exercise device of claim 11, wherein said decline control pin is adjustable relative to said decline control slot defined in said trailing arm so that said maximum angle of decline may be varied to provide variable operable decline angle ranges.

17. The exercise device of claim 16, wherein said decline control mechanism is connected to said support frame and includes a decline control slot and a decline control knob threadably received on said decline control pin, said decline control slot being configured to receive said decline control pin and said decline control knob adapted to secure said decline control pin to said decline control slot in two or more different decline positions, wherein in each of said two or more different decline positions a position of said decline control pin relative to said decline control slot is different so that said maximum angle of decline is different, providing two or more operable decline angle ranges.

18. The exercise device of claim 8, wherein said first surface of said back rest further comprises a lumbar support structure, said lumbar support structure adapted to provide supplemental support to said back of said user.

19. The exercise device of claim 8, further comprising at least one hand grip connected to said back rest and adapted to provide grip support for at least one hand of said user when in said exercise position.

20. The exercise device of claim 8, further comprising a foot rest connected to said seat and adapted to provide support for the feet of said user when in said exercise position.

21. The exercise device of claim 8, further comprising a support bar pivotally attached to said support frame and operable to selectively and statically support said back rest at an angle of decline that places said user in a supine position.

22. An exercise device, comprising:

a back rest having first and second ends;

a seat having first and second ends, said first end of said seat being pivotably attached to said second end of said back rest at a device pivot point, wherein a plane of said back rest and a plane of said seat form an angle of decline therebetween; and a support frame pivotally supporting said back rest at a first point positioned between said first and second ends of said back rest, and pivotally supporting said seat at a second point positioned between said first and second ends of said seat;

a decline control mechanism, comprising:

a trailing arm having first and second ends and a decline control slot defined therein between said first and second ends of said trailing arm, said decline control slot being closed at each end; said first end of said trailing arm being pivotally attached to said extension platform at a point adjacent said device pivot point, a decline control pin connected to said support frame, said decline control pin being received in said decline control slot so that adjustment of said angle of decline causes said decline control slot to slidably travel about said decline control pin, said adjustment of said angle of decline being limited to an operable decline angle range by contact of each of said closed ends of said control slot with said decline control pin, a friction control mechanism comprising a brake control wheel having a brake surface, said brake control wheel being threadably received on said decline control pin so as to have an axis of rotation centered around said decline control pin; and wherein threadable rotation of said brake control wheel about said decline control pin causes said brake surfaces to contact said trailing arm so as to adjustably and frictionally resist sliding movement of said decline slot of said trailing arm about said decline pin, wherein an amount of said frictional resistance is controllable by threadable rotation of said brake control wheel, and a decline control knob threadably received on said decline control pin, said decline control slot being configured to receive said decline control pin and said decline control knob adapted to secure said decline control pin to said decline control slot in two or more different decline positions, wherein in each of said two or more different decline positions a position of said decline control pin relative to said decline control slot is different so that the limits of said angle of decline is different, providing two or more operable decline angle ranges;

wherein said back rest and said seat together form an extension platform adapted to receive a user in an exercise position wherein said first surface of said back rest supports an upper back of said user, and wherein said first surface of said seat supports a posterior of said user; and wherein said angle of decline is adjustable up to a maximum value of from about 180° to about 235°.

23. The exercise device of claim 22, further comprising:

first and second hand grips connected to said back rest and adapted to provide support for the hands of said user when in said exercise position;

a foot rest connected to said seat and adapted to provide support for the feet of said user when in said exercise position; and wherein said first surface of said back rest further comprises a lumbar support structure, said lumbar support structure adapted to provide supplemental support to said back of said user.

24. The exercise device of claim 23, further comprising a support bar pivotally attached to said support frame and operable to selectively and statically support said back rest at an angle of decline that places said user in a supine position.

* * * * *